US007238422B2

(12) United States Patent
Buczek

(10) Patent No.: US 7,238,422 B2
(45) Date of Patent: Jul. 3, 2007

(54) ENVIRONMENTALLY STABLE HIGH RESISTIVITY CARBON FIBER AND METHOD OF PRODUCING

(75) Inventor: Matthew B. Buczek, Hamilton, OH (US)

(73) Assignee: General Electric Company, Schenectady, NY (US)

( * ) Notice: Subject to any disclaimer, the term of this patent is extended or adjusted under 35 U.S.C. 154(b) by 288 days.

(21) Appl. No.: 10/735,367

(22) Filed: Dec. 12, 2003

(65) Prior Publication Data

US 2005/0129938 A1 Jun. 16, 2005

(51) Int. Cl.

| | |
|---|---|
| ***B32B 19/00*** | (2006.01) |
| ***B32B 9/00*** | (2006.01) |
| ***C01B 31/00*** | (2006.01) |
| ***D01F 9/12*** | (2006.01) |

(52) U.S. Cl. ..... 428/357; 428/367; 264/29.1; 423/447.1

(58) Field of Classification Search ..... 264/29.2, 264/29.7, 29.1; 423/447.2, 447.6, 447.1; 428/367, 369, 371, 357
See application file for complete search history.

(56) References Cited

U.S. PATENT DOCUMENTS

| | | | | |
|---|---|---|---|---|
| 4,339,322 | A | | 7/1982 | Balko et al. |
| 4,728,395 | A | | 3/1988 | Boyd et al. |
| 4,776,995 | A | | 10/1988 | Nelson et al. |
| 4,816,242 | A | | 3/1989 | Venner et al. |
| 4,836,875 | A | | 6/1989 | Buttermore et al. |
| 4,856,147 | A | | 8/1989 | Armiger et al. |
| 5,079,037 | A | | 1/1992 | Morrison et al. |
| 5,098,688 | A | * | 3/1992 | Schimpf et al. ..... 423/447.2 |
| 5,179,778 | A | | 1/1993 | Dickson et al. |
| 5,196,212 | A | | 3/1993 | Knoblach |
| 5,268,158 | A | * | 12/1993 | Paul, Jr. ..... 423/447.1 |
| 5,356,707 | A | * | 10/1994 | McCullough et al. ..... 428/367 |
| 5,628,955 | A | | 5/1997 | Houk |
| 5,824,996 | A | * | 10/1998 | Kochman et al. ..... 219/529 |
| 6,025,285 | A | | 2/2000 | Vyakarnam et al. |

* cited by examiner

*Primary Examiner*—N. Edwards
(74) *Attorney, Agent, or Firm*—McNees Wallace & Nurick LLC

(57) ABSTRACT

A carbon composite construction includes carbon fibers having a controlled level of electrical resistance. The controlled level of electrical resistance is achieved by subjecting the carbon fibers to a predetermined stress level during the stabilization process. The carbon fibers produced by this method are blended with nonconductive fibers to produce the composite construction.

15 Claims, 4 Drawing Sheets

$\sigma_1 < \sigma_2 < \sigma_3 < \sigma_4$

ENVIRONMENTALLY STABLE HIGH RESISTIVITY CARBON FIBER AND METHOD OF PRODUCING

BACKGROUND OF THE INVENTION

The present invention relates generally to a carbon fiber composition and method for making same. Specifically, the present invention relates to a carbon fiber composition having a controlled, predetermined electrical resistance level and method for making same.

Composite materials comprising laminated plies of carbon fiber reinforced in a resin matrix are often used due to their high strength to weight ratio. However, in addition to the structural aspects, many applications can greatly benefit from the composite materials having controlled electrical resistance levels. Such applications including engine components, aircraft or land based weapon systems, and heating elements of various kinds, including resistance heating elements, thermal heaters and flexible heating units.

Currently, to make use of carbon fibers in a composite having controlled, lower resistance levels, the amount of carbon fibers must be evenly distributed at extremely low concentrations, or loading levels, such as less than 0.1 percent carbon by weight, due to the relatively high conductivity of the carbon fibers. It is extremely difficult to work with carbon fibers at this low concentration level. Alternately, carbon fibers have been incorporated into paper-thin plies that are sandwiched between layers of highly resistive structural composites. Although this construction method has produced promising results, the process of arranging the plies is manual, and hence, is extremely expensive, and impractical for commercial use.

Another alternate construction method is commingling the carbon fibers with nonconductive fibers. However, due to the high conductivity of carbon fibers, the ratio of nonconductive fibers, such as glass or quartz filaments, to each carbon segment would need to be several thousand to one. Further, due to the relatively high degree of brittleness, the resulting material simply cannot be handled without breakage. Currently, techniques of blending glass and carbon exist, such as stretch-breaking, but even stretch-breaking can only blend glass and carbon fibers within a ratio range of about several hundred to one.

In conventional polyacrylonitrile (PAN) carbon fiber processing, the electrical conductivity of the resulting carbon fibers is affected by the carbonization temperature, the carbonization time and the internal orientation of the carbon planes within a filament. For example, referring to FIG. 1 for prior art carbon fibers, the y axis corresponds to the log of resistivity values which likewise correspond to the carbonization temperature (x-axis) to produce a nonlinear relationship between resistivity and temperature. As is shown, the log of resistivity values ranges from about 3,100 microohms per cm at about 1,000° C. to less than 1,000 microohms per cm at about 2,750° C. This range of resistivity values is not acceptable in many electrically sensitive applications.

Carbon fibers having an increased level of electrical resistance are commercially available. However, these carbon fibers are produced by attempting to carbonize the carbon fibers at a lower temperature than is used to produce carbon fibers having lower resistance levels. In fact, at these lower temperatures, the carbon fibers are not fully carbonized, that is, they are not fully converted to carbon, and are believed to retain nitrogen impurities in the fibers. The carbon fibers produced at the lower carbonizing temperatures by this method are not environmentally stable in that their electrical resistance levels change significantly over time, even at room temperature, and further vary with a change in temperature. The reason for the fluctuation in resistance of the carbon fibers is believed to be caused by the retained nitrogen which results in an increased propensity of the carbon fibers to accumulate moisture in an unpredictable manner.

Therefore, what is needed is a method for integrating carbon fibers into a composite construction having a wide range of controllable electrical resistance levels that remains substantially unchanged over a wide range of operating conditions which is easy and inexpensive to make.

SUMMARY OF THE INVENTION

The present invention is directed to a fiber tow having a controlled, predetermined electrical resistance including a predetermined number of carbon fibers forming a tow and a method for making such a fiber tow. The tow is subjected to a predetermined stress level while simultaneously being subjected to a first predetermined elevated temperature associated with fabricating the tow.

The present invention is also directed to a method for fabricating a fiber tow having a controlled, predetermined electrical resistance includes the steps of providing a predetermined number of carbon fibers to form a fiber tow, and then stressing the tow to a predetermined stress level while simultaneously subjecting the tow to a predetermined elevated temperature associated with fabricating the tow.

The present invention is further directed to a method for fabricating a tow having a controlled, predetermined electrical resistance, the steps comprising: providing a predetermined number of carbon PAN fibers defining a predetermined number of filaments forming a portion of a tow; stressing the predetermined number of carbon PAN fibers to a predetermined stress level while simultaneously subjecting the predetermined number of carbon fibers to a predetermined elevated temperature associated with fabricating the predetermined number of carbon PAN fibers; subjecting the predetermined number of carbon PAN fibers to a second predetermined elevated temperature associated with fabricating the carbon PAN fibers, the second predetermined elevated temperature converting the predetermined number of carbon PAN fibers to carbon fibers defining a predetermined number of carbon fiber filaments; providing a predetermined number of nonconductive fibers defining a predetermined number of segments forming a portion of a tow; and blending the predetermined number of carbon fiber filaments with the predetermined number of nonconductive fiber filaments to form a tow.

The predetermined elevated temperature associated with fabricating the tow is preferably during the stabilization process, which is the process used to render the carbon fiber precursor infusible, that is, not capable of melting when heated, prior to carbonization. Typically, stabilization subjects the carbon fibers to temperatures of about 250° C. for about several hours, without need to prepare a special environment, such as one without oxygen. Once the fibers have passed through the stabilization process, they are subjected to carbonization. Carbonization is defined as the preparation of carbon fibers from a precursor, such as PAN fibers, involving a heat treatment in the presence of nitrogen or other inert gas at about 250° C. to about 1,500° C. The carbon fibers are slowly heated to the maximum range during the carbonization process to allow the high degree of alignment, or order, present in the fibers to be maintained.

By sufficiently controlling the rate of heat increase, the molecular order present in the fibers is not destroyed. Optionally, the fibers may then be subjected to a process called graphitization which further improves the properties of the carbon fibers. Graphitization involves further heating the fibers typically between about 1,500° C. and 2,500° C., and even up to about 3,000° C. for extremely short time durations, typically less than one minute. It has been shown that while strength remains substantially constant, the elastic modulus, often referred to Young's modulus or tensile modulus, continues to increase as a function of increased final heat treatment temperature. That is, for graphitization temperatures between about 1800° C. to more than 2,400° C., there is a substantially linear increase in tensile modulus of from about 39 Msi (million pounds per square inch) to about 55 Msi. As will be discussed in further detail below, the present invention does not contemplate deviation to any significant degree from the either the carbonization temperatures or carbonization times typically employed in the conventional fabrication of carbon composites.

The term turbostratic is defined as a type of crystalline structure where the basal planes have slipped sideways relative to each other, causing the spacing between planes to be greater than ideal. While the carbon fibers have strong covalent bonds which substantially maintain the strength of the tow, the resistivity of the tow is lowered. In other words, as a result of this basal plane slippage, electrons cannot travel nearly as easily, if at all, along the basal planes, thereby raising the level of electrical resistance through the tow.

One advantage of the composite construction of the present invention is that it is inexpensive to make.

Another advantage of the composite construction of the present invention is that it is both elastically complaint while having a wide range of controlled electrical resistance levels.

An additional advantage of the method for forming composite constructions of the present invention is that it can produce carbon fiber tows having electrical resistance levels that differ by about two orders of magnitude.

A further advantage of the composite construction of the present invention is that the level of electrical resistance in the carbon fiber tows is substantially constant over a broad range of temperatures and other environmental conditions.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
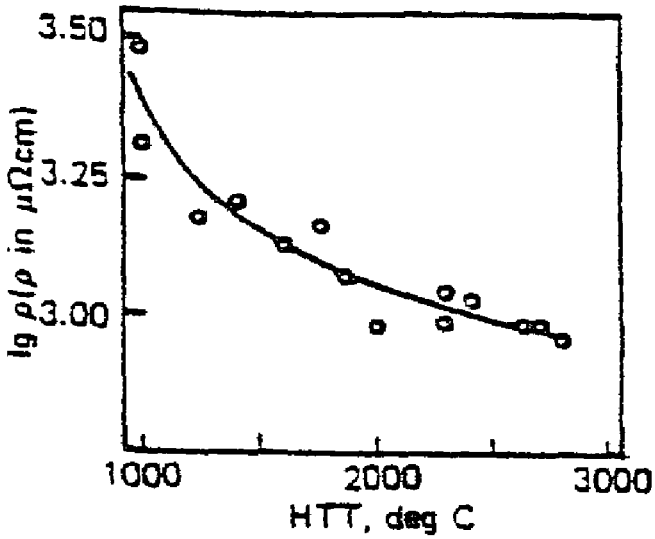
FIG. 1 is a graph showing a logarithmic relationship between resistivity and carbonization temperature of a prior art carbon composite construction.
Figure 2:
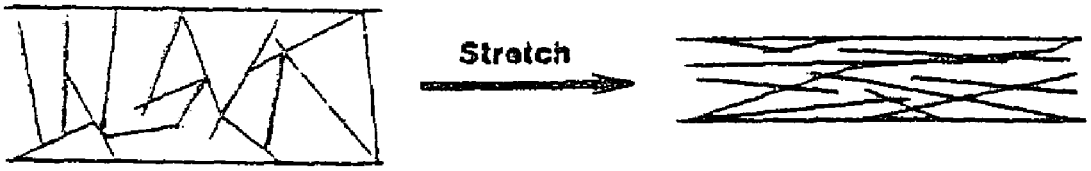
FIG. 2 is a pair of schematic representations showing a relationship between the orientation of PAN molecules and tensile load in a precursor filament during the stretch stabilization process of the carbon fiber.
Figure 3:
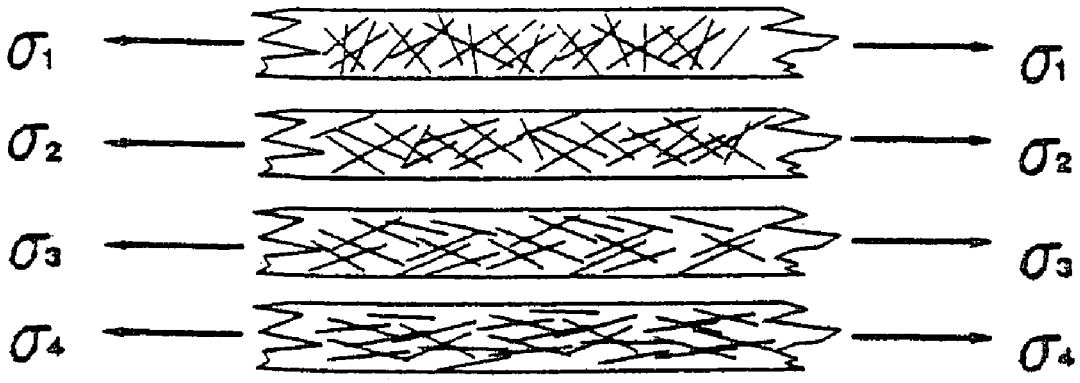
FIG. 3 is a set of four schematic representation showing a relationship between increasing stress levels and the orientations of the PAN molecules in the filament of the present invention.
Figure 5:
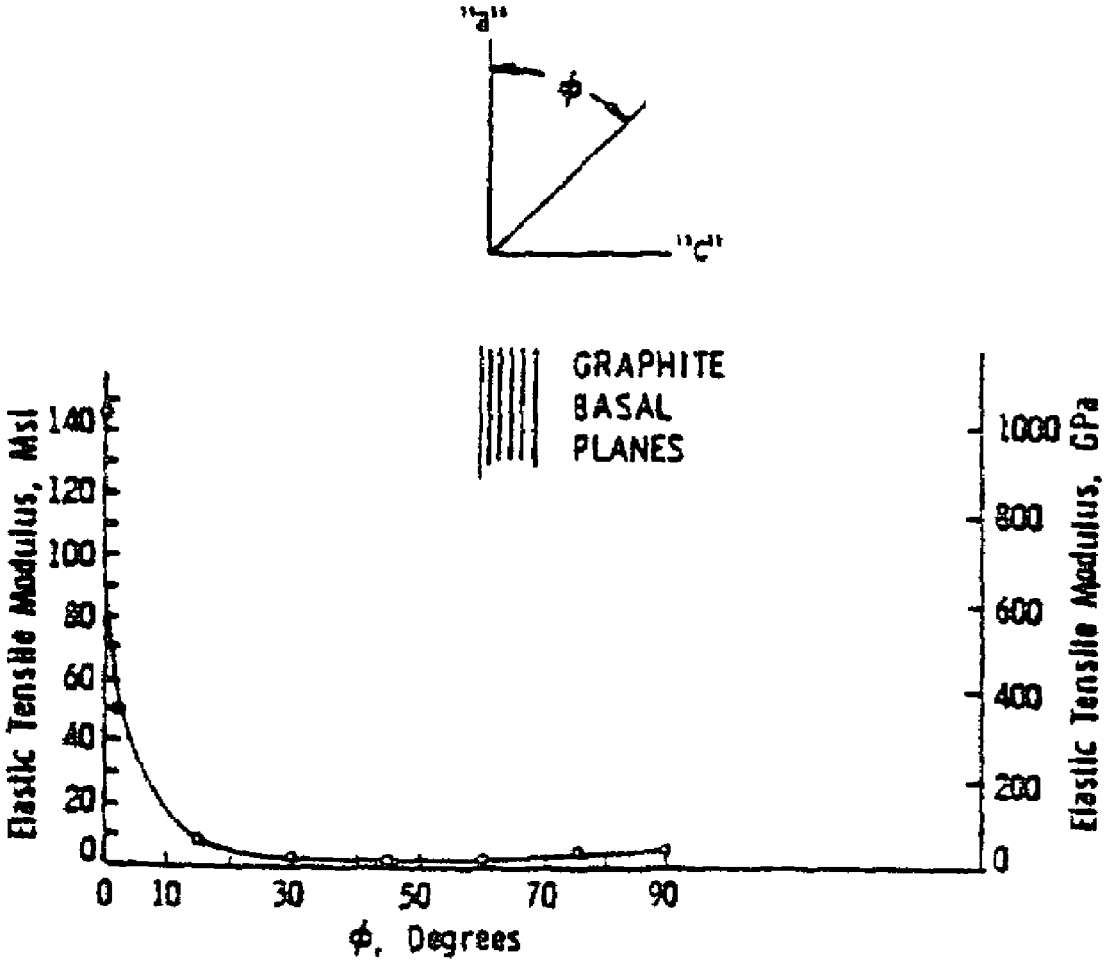
FIG. 5 is a graph showing a relationship between the elastic tensile modulus and alignment angles of carbon basal planes with respect to the direction of the filament of the present invention.

A typical composite filament construction to which the invention can be applied is illustrated, by means of example, in FIG. 2. As shown, a segment 10 of PAN filaments includes a plurality of carbon PAN molecules 12 disposed in various orientations within filament 10. While it is realized that tows are each comprised of a large number of filaments, such as 1,000 or more, the carbon fibers are generally referred to in their collective construction sense, or tows. As used herein, the term carbon fiber includes precursors from which carbon fibers are produced, such as PAN, rayon and pitch. The orientation of the carbon filaments is expressed in terms of a basal plane that is defined as the plane which is perpendicular to the principal axis in a tow construction. The basal plane is shown in FIG. 5 as a series of horizontal parallel lines, and is also shown perpendicular to axis "c" in a schematic appearing immediately adjacent the basal planes showing axes "a" and "c", wherein axis "c" represents the principal axis in a tow construction. Within the framework of axes "a" and "c", any deviation from the basal plane is expressed as an alignment angle 14, and by the letter Φ. In FIGS. 2 and 3, the letter Φ is accompanied by a suitable subscript to clarify the magnitude of alignment angle 14 between different filament configurations. As will be explained in further detail below, by varying the alignment angle of the PAN molecular orientations while the carbon fibers are being subjected to elevated temperatures associated with the fabrication of the tow, the electrical resistance of the tow can be controlled and varied over a wide range of values.

Referring to FIG. 2, a segment 10 of PAN molecules is depicted both before and after being subjected to a tensile load, or being "stretched." The PAN molecule segment 10 prior to stretching which is identified in FIG. 2 as "before stretch," further identifies a particular PAN molecule 12 that defines alignment angle 14 with respect to the length of the segment 16, which alignment angle 14 being identified as $\Phi_{before}$. Upon the application of a continued tensile load, the PAN molecule segment 10 that is being stretched which is identified in FIG. 2 as "after stretch," further identifies a particular PAN molecule 12 that defines alignment angle 14 with respect to filament length 16, which alignment angle 14 being identified as $\Phi_{after}$. Upon the application of the tensile load to the "after stretch" PAN molecule segment 10, it is apparent that overall, the PAN molecules 12 begin to orient themselves in alignment with the filament length 16. Stated another way, the magnitude of the alignment angle 14 which is designated as $\Phi_{before}$ between PAN molecules 12 and filament length 16 for the unstressed PAN molecule segment 10, decreases to $\Phi_{after}$ once the PAN segment 10 is subjected to a tensile load.

Referring to FIG. 3, the relationship between tensile stress, which is tensile load per unit area, and alignment angle 14, which is shown as Φ, is further discussed. FIG. 3 shows four PAN segments 10. To differentiate between each of the four PAN segments, the numerical subscript for stress, the letter σ, and alignment angle 14, the letter Φ, are the same for a given PAN segment and unique for that given segment. Thus, subscripts 1-4 correspond to respective segments 1 through 4 to uniquely identify each of the segments 10. In other words, the first segment 10 is subjected to $\sigma_1$ and defines alignment angle $\Phi_1$, the second segment 10 is subjected to $\sigma_2$ and defines alignment angle $\Phi_2$, with the same convention being applied to the remaining third and fourth segments 10. For sake of clarity, it is assumed that the cross sectional area of each of the four segments 10 is substantially the same, so that if each of the four segments 10 were subjected to substantially the same tensile load, the resulting tensile stresses in each of the segments would be substantially the same. However, while the cross sectional areas for each of the four segments are essentially identical, the tensile load applied to the first segment is less than the tensile load applied to the second segment and so on, such that the tensile load applied to the fourth segment is greater than that applied to any of the other segments. Similarly, it follows that the tensile stress acting on the first segment ($\sigma_1$) is less than the tensile stress acting on the second segment ($\sigma_2$), which is less than the tensile stress acting on the third segment ($\sigma_3$), which is less than the tensile stress acting on the fourth segment ($\sigma_4$). This relationship is expressed symbolically in equation 1.

$$\sigma_1<\sigma_2<\sigma_3<\sigma_4 \quad [1]$$

As further shown in FIG. 3 using the four segments for illustration, there is an inverse relationship between stress levels, $\sigma$, and angular alignment angles $\Phi$. In other words, as the stress levels increase, the corresponding alignment angles decrease. For example, for the first segment 10, alignment angle $\Phi_1$, which measures the angle between PAN molecules 12 and filament length 16, has the largest magnitude when compared to the alignment angles of the other segments, and corresponds to stress level $\sigma_1$, which is the lowest stress level. For the second segment 10, alignment angle $\Phi_2$ has a magnitude that is less than alignment angle $\Phi_1$, and corresponds to stress level $\sigma_2$, which corresponds to a higher stress level than stress level $\sigma_1$. For the third segment 10, alignment angle $\Phi_3$ has a magnitude that is less than alignment angle $\Phi_2$, and corresponds to stress level $\sigma_3$, which corresponds to a higher stress level than stress level $\sigma_2$. Finally, for the fourth segment 10, alignment angle $\Phi_4$ has a magnitude that is less than alignment angle $\Phi_3$, and corresponds to stress level $\sigma_4$, which corresponds to a higher stress level than stress level $\sigma_3$. In other words the fourth segment 10 has the smallest alignment angle, $\Phi_4$, while having the highest stress level $\sigma_4$. This relationship is expressed symbolically in equation 2.

$$\Phi_1>\Phi_2>\Phi_{3>\Phi 4} \quad [2]$$

Therefore, what FIG. 3 shows, is that in response to subjecting PAN filaments to increased stress levels, the corresponding alignment angles between the molecules and the respective filament lengths are decreased. On carbonization, this results in a high level of alignment of the basal planes.

While not wishing to be bound by theory, it is believed that by subjecting the filaments to a predetermined stress level to vary the alignment angles of basal planes in the filaments while simultaneously subjecting the segments to a predetermined elevated temperature associated with fabricating the filament, it is possible to fabricate filaments and collectively tows comprising layers material in the form of a tow, with varying degrees of "preferred" turbostratic orientation.

The predetermined elevated temperature associated with fabricating the tow is preferably during the stabilization process, which is the process used to render the carbon fiber precursor infusible, that is, not capable of melting when heated, prior to carbonization. Typically, stabilization subjects the carbon precursor fibers to temperatures of about 250° C. for about several hours, without need to prepare a special environment, such as one without oxygen. Once the precursor fibers have passed through the stabilization process, they are subjected to carbonization. Carbonization is defined as the preparation, or conversion, of carbon fibers from a precursor, such as PAN fibers, involving a heat treatment in the presence of nitrogen or other inert gas at about 250° C. to about 1,500° C. The carbon fibers are slowly heated to the maximum range during the carbonization process to allow the high degree of alignment, or order, present in the fibers to be maintained. By sufficiently controlling the rate of heat increase, the molecular order present in the fibers is not destroyed. Optionally, the fibers may then be subjected to a process called graphitization which further improves the properties of the carbon fibers. Graphitization involves further heating the fibers typically between about 1,500° C. and 2,500° C., and even up to about 3,000° C. for extremely short time durations, typically less than one minute. It has been shown that while strength remains substantially constant, the elastic modulus, often referred to Young's modulus or tensile modulus, continues to increase as a function of increased final heat treatment temperature. That is, for graphitization temperatures between about 1800° C. to more than 2,400° C., there is a substantially linear increase in tensile modulus of from about 39 Msi (million pounds per square inch) to about 55 Msi. As will be discussed in further detail below, the present invention does not contemplate deviation to any significant degree from the either the carbonization temperatures or carbonization times typically employed in the conventional fabrication of carbon composites.

The term turbostratic is defined as a type of crystalline structure where the basal planes have slipped sideways relative to each other, causing the spacing between planes to be greater than ideal. While the carbon fibers have strong covalent bonds which substantially maintain the strength of the tow, the resistivity of the tow is lowered. In other words, as a result of this basal plane slippage, electrons cannot travel nearly as easily, if at all, along the basal planes, thereby raising the level of electrical resistance through the tow.

Figure 4:
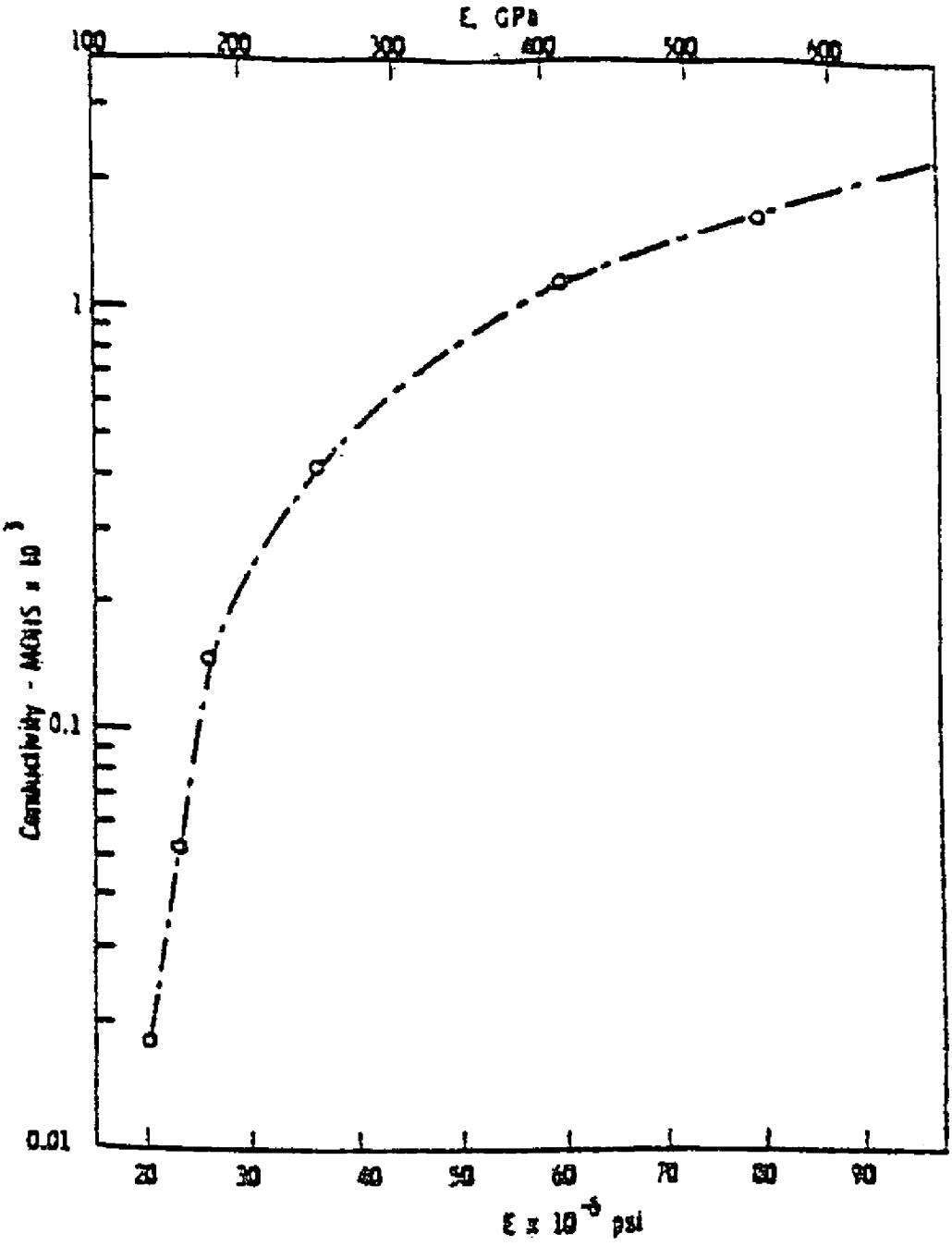
FIG. 4 is a graph showing a relationship between conductivity and an elastic tensile modulus of a tow of the present invention.

The relationship between the alignment angle of filament basal planes within a tow and the electrical conductivity of the tow is shown in FIGS. 4-5. FIG. 4 shows a logarithmic relationship between conductivity of a tow and an elastic tensile modulus of the tow. FIG. 5 shows a relationship between the elastic tensile modulus of the fiber tow and alignment angles of the filament length with respect to the basal planes of the tow. Referring back to FIG. 4, it is shown than conductivity, measured in kilo-ohms (mega ohms enhanced by a factor of 1,000), ranges from slightly less than 0.02 kilo-ohms at about 20 Msi to approximately 1.05 kilo-ohms at about 80 Msi. Thus, over the recorded range of elastic tensile modulus values for the fiber tow, the conductivity increased by a factor of about 67 from the lowest to the highest measured elastic tensile modulus. For purposes of discussion, carbon fibers having an elastic tensile modulus along the lower end of the range, especially about 20 Msi, are considered lower modulus carbon fibers.

Referring back to FIG. 5, it is shown that lower modulus carbon fibers of about 20 Msi corresponds to an alignment angle of about 10 degrees. Therefore, by reducing the elastic tensile modulus from about 60 Msi to about 20 Msi, a reduction of conductivity from about 1.2 to about 0.018 giga ohms, or approximately a factor of 67 times is achieved. To reduce the modulus of carbon fibers from 60 Msi to 20 Msi, the alignment angle of carbon fibers is increased from about 2 degrees to about 10 degrees. Although carbon fiber tows having significantly different ranges of electrical resistance values can now be produced, since the carbon fiber tows are produced using conventional carbonization times and temperatures, the electrical resistance values remain substantially constant over a wide range of operating conditions. In other words, the carbon tows produced by the method of the present invention are not subject to fluctuations in electrical resistance values, which fluctuations are believed to result from nitrogen retention in the fibers. Thus, the carbon tows are considered to have a substantial equivalent oxidative stability for fibers produced having any degree of orientation. It is also realized that the alignment angle can be significantly greater than 10 degrees, such as up to about 30 degrees, although the modulus is reduced. Alternately if the alignment angle is less than 10 degrees, the modulus and strength are increased, but the resistance is decreased. In other words, depending upon the desired properties, the alignment angle can vary anywhere between 0 and about 30 degrees.

In operation, to achieve the beneficial electrical resistance reduction afforded by the lower strength carbon fibers without suffering a significant reduction in the strength of the tow, the carbon fibers produced by the method of the present invention can be mixed with nonconductive fibers. Examples of nonconductive fibers include glass, ceramics, such as alumina and alumina oxide, ceramic oxides, such as silicon carbide or other carbides, quartz, which is substantially pure silicon oxide, and polymeric fibers such as Kevlar®, which is a registered trademark of E. I. du Pont de Nemours and Company, or polyurethanes For example, a blend of from about one to about ten percent by weight lower strength carbon fibers mixed with remaining glass or quartz fibers will produce a composite having a desirable electrical conductivity without a significant loss in strength. The resulting hybrid carbon-glass, or carbon-quartz tow could be woven to form a fabric layer, with multiple layers, or laminates being overlaid to form a preform having a bulk resistivity for use in many applications. The preform could then be processed by resin transfer molding (RTM) to produce low cost composite components.

In a first example, up to about 100 filaments of lower strength carbon fibers of the present invention are blended with remaining nonconductive filaments to comprise a tow containing about 5,000 filaments. The resulting blended tow has a ratio of carbon fibers to nonconductive fibers of about 50:1, with the resulting blended tow having a resistance value that is reduced by a 1-2 order of magnitude. Although the modulus and strength of the blended fabric is reduced, the strain failure rate is not reduced. Thus, this blended tow retains flexibility and may be used to produce, for example, gloves or heating elements.

In a second example, between about 50 to 100 filaments of lower strength carbon fibers of the present invention are blended with remaining nonconductive filaments to comprise a tow containing about 5,000 filaments employing the stretch breaking technique. The resulting blended tow has a ratio of carbon fibers to nonconductive fibers of from about 100:1 to about 50:1, with the resulting blended tow having a resistance value that is increased by a 2-3 order of magnitude. Due to a reduced number of lower strength carbon fibers in the blended tow, the modulus and strength is higher than the first example, and flexibility is maintained. However, it is realized that this ratio can significantly differ depending on the desired resistance level. That is, while a 50:1 ratio is discussed, ratios ranging from about 50:1 to about 1:50 are achievable.

It is appreciated that by varying any combination of the degree of strength reduction of the carbon fibers used, the number of carbon fibers used per blended tow, and the possibility of employing techniques such as stretch breaking, the amount of resistance reduction of a blended tow may vary from less than one to about three orders of magnitude. The application requirements, including the criticality of factors such as strength, flexibility, and magnitude of resistance reduction may be used to determine optimum combinations.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A tow having a controlled, predetermined electrical resistance comprising:

a predetermined number of carbon fibers forming a tow;

wherein the tow has an alignment angle from between 0 to 30 degrees after being subjected to a predetermined stress level while simultaneously being subjected to a first predetermined elevated temperature associated with fabricating the tow, and wherein the predetermined stress level decreases an alignment angle between at least one carbon molecule within the predetermined number of carbon fibers with respect to a basal plane.

2. The tow of claim 1, wherein the alignment angle is about ten degrees.

3. The tow of claim 1, wherein the first predetermined elevated temperature is associated with a stabilization process.

4. The layer of claim 1, wherein the carbon fibers have a predetermined degree of turbostratic orientation.

5. The layer of claim 1, wherein an electrical resistance of the tow is increased by up to about an order of magnitude of 2.

6. A method for fabricating a tow, the steps comprising:

providing a predetermined number of carbon precursor fibers to form a tow;

stressing the tow to a predetermined stress level while simultaneously subjecting the tow to a first predetermined elevated temperature associated with fabricating the tow; and subjecting the tow to a second predetermined elevated temperature associated with fabricating the tow, the resulting tow having a controlled, predetermined electrical resistance, and wherein the tow has an alignment angle from between 0 to 30 degrees after being subjected to a predetermined stress level while simultaneously being subjected to a first predetermined elevated temperature associated with fabricating the tow, and wherein the predetermined stress level decreases an alignment angle between at least one carbon molecule within the predetermined number of carbon fibers with respect to a basal plane.

7. The method of claim 6, wherein the first predetermined elevated temperature of the tow stressing step is associated with the stabilization process.

8. The method of claim 6, wherein the second predetermined elevated temperature of the tow stressing step is associated with the carbonization process.

9. The method of claim 6, further including the additional step of subjecting the tow to a third predetermined elevated temperature associated with fabricating the tow.

10. The method of claim 6, wherein the predetermined number of carbon precursor fibers are comprised of carbon polyacrylonitrile fibers.

11. The method of claim 9, wherein the third predetermined elevated temperature of the tow stressing step is associated with a graphitization process.

12. A method for fabricating a tow having a controlled, predetermined electrical resistance, the steps comprising:

providing a predetermined number of carbon polyacrylonitrile fibers defining a predetermined number of filaments forming a portion of a tow;

stressing the predetermined number of carbon polyacrylonitrile fibers to a predetermined stress level while simultaneously subjecting the predetermined number of carbon polyacrylonitrile fibers to a first predetermined elevated temperature associated with fabricating the predetermined number of carbon polyacrylonitrile fibers;

subjecting the predetermined number of carbon polyacrylonitrile fibers to a second predetermined elevated temperature associated with fabricating the carbon polyacrylonitrile fibers, the second predetermined elevated temperature converting the predetermined number of carbon polyacrylonitrile fibers to carbon fibers defining a predetermined number of carbon fiber filaments;

providing a predetermined number of nonconductive fibers defining a predetermined number of filaments forming a portion of a tow; and blending the predetermined number of carbon fiber filaments with the predetermined number of nonconductive fiber filaments to form a tow, and wherein the tow has an alignment angle from between 0 to 30 degrees after being subjected to a predetermined stress level while simultaneously being subjected to a first predetermined elevated temperature associated with fabricating the tow, and wherein the predetermined stress level decreases an alignment angle between at least one carbon molecule within the predetermined number of carbon fibers with respect to a basal plane.

13. The method of claim 12 wherein in the blending step a ratio of the predetermined number of carbon fiber filaments to the predetermined number of nonconductive fiber filaments is about 50:1.

14. The method of claim 12 wherein the blending step is a stretch breaking process.

15. The method of claim 14 wherein in the blending step a ratio of the predetermined number of carbon fiber filaments to the predetermined number of nonconductive fiber filaments is from about 50:1 to about 1:50.

* * * * *